United States Patent [19]

White

[11] Patent Number: 5,039,557

[45] Date of Patent: Aug. 13, 1991

[54] METHOD FOR EMBEDDING REFLECTIVE BEADS IN THERMOPLASTIC PAVEMENT MARKING LINES

[76] Inventor: Terrence H. White, 354 Jerusalem Rd., Cohasset, Mass. 02025

[21] Appl. No.: 427,870

[22] Filed: Oct. 26, 1989

[51] Int. Cl.[5] ..... B05D 5/10

[52] U.S. Cl. ..... 427/137; 427/204; 427/398.3; 427/140; 427/198; 404/75; 404/93

[58] Field of Search ..... 427/136, 137, 197, 163, 427/198, 204, 348.3, 140, 198; 404/75, 93

[56] References Cited

U.S. PATENT DOCUMENTS

| | | | |
|---|---|---|---|
| 2,268,538 | 12/1941 | Rodli et al. . | |
| 2,574,971 | 11/1951 | Heltzer . | |
| 3,204,537 | 9/1965 | Searight . | |
| 3,215,051 | 11/1965 | Gill . | |
| 3,253,971 | 5/1966 | Garling . | |
| 3,410,185 | 11/1968 | Harrington . | |
| 3,617,333 | 11/1971 | Brown . | |
| 3,664,242 | 5/1972 | Harrington et al. . | |
| 3,877,787 | 4/1975 | Buzbee et al. . | |
| 4,071,384 | 1/1978 | Eigenmann . | |
| 4,104,102 | 8/1978 | Eagon et al. . | |
| 4,117,192 | 9/1978 | Jorgensen . | |
| 4,162,862 | 7/1979 | Harker et al. . | |
| 4,185,132 | 1/1980 | Gurney . | |
| 4,192,576 | 3/1980 | Tung et al. . | |
| 4,288,487 | 9/1981 | Eigenmann . | |
| 4,623,279 | 7/1984 | Smith | 427/137 |
| 4,856,931 | 8/1989 | Bollog | 427/136 |

*Primary Examiner*—Shrive E. Beck
*Assistant Examiner*—Benjamin L. Utech
*Attorney, Agent, or Firm*—Cesari & McKenna

[57] ABSTRACT

A method and apparatus for applying or re-applying retro-reflective glass beads to in-place thermoplastic pavement marking lines. A heated container warms the beads to a temperature below their melting point but above the melting point of the line. The heated beads are then uniformly dispersed onto the surface of the line. Heat from each bead is thereby transferred into the surrounding thermoplastic material, causing the material to melt and the bead to adhere. The beads are then embedded into the thermoplastic by suitable means such as a roller. By adjusting the temperature of the beads and/or the downward force of the rollers, the depth of the embedded beads can be controlled for optimum reflectivity and adhesion, and variations in ambient operating conditions can be accommodated. The line is usable by traffic essentially immediately after bead application. The same apparatus can be used to apply beads of varying sizes. Associated mechanical support equipment and procedures are consistent with exiting techniques, making the invention amenable to small scale manual operation as well as extensive automatic highway operation.

3 Claims, 2 Drawing Sheets

METHOD FOR EMBEDDING REFLECTIVE BEADS IN THERMOPLASTIC PAVEMENT MARKING LINES

FIELD OF THE INVENTION

This invention relates generally to pavement marking, and particularly to the application of reflective glass beads to thermoplastic pavement marking lines which have already been applied to the pavement.

BACKGROUND OF THE INVENTION

The durability of pavement marking lines has been greatly improved in the past few years through the use of thermosetting polymers, or thermoplastics. Thermoplastics are directly applied to the pavement. Alternatively, thermoplastics can be extruded and rolled into adhesive tapes in a factory and then unrolled applied to the pavement in the field. Such thermoplastic marking lines have been found to last for up to seven years, depending of course upon the weather and amount of traffic to which they are subjected.

It is also known that the wet- and night-visibility of thermoplastic markings can be greatly improved by partially embedding reflex-reflective glass spheres or beads into their upper surface. The method of accomplishing this is to drop the beads into liquid thermoplastic immediately after the thermoplastic is applied to the pavement. However, a significant portion of the original reflectivity can be lost after only a year or so. This is due to the fact that the glass beads are either worn away or shocked out of position by the passing vehicles, especially heavy vehicles such as snowplows.

While it would seem advantageous to re-reflectorize thermoplastic markings by simply applying a new layer of beads, attempts to do so to date have been less than satisfactory. In particular, problems arise when an attempt is made to reapply reflective beads to an existing marking in a method directly analogous to the original application method. First, the existing marking must be heated to return it to the near-liquid state so that it will accept the replacement reflective beads. Unfortunately, it is often necessary to scorch or even burn the existing marking to cause it to melt sufficiently. This tends to result in a discolored marking. Even if heating is carefully controlled to avoid discolorations, a non-uniform embedding surface, and hence diminished reflectivity, may result because of pavement condition variations.

SUMMARY OF THE INVENTION

It is an object of this invention to provide an improved method and apparatus for applying glass beads to in-place thermoplastic pavement markings.

In brief summary, the invention preheats retro-reflective glass beads stored in a container. The beads are heated to a temperature below their melting point but above the melting point of the existing thermoplastic pavement marking. An insulated pipe funnels the beads from the storage container to a dispenser. The dispenser uniformly separates and disperses the beads into a lower chamber, immediately dropping them onto the marking. Heat from each bead is then transferred into the surrounding thermoplastic material, causing the material to melt and the bead to adhere. The beads are then embedded into the thermoplastic by rollers positioned to the rear of the chamber.

The rollers provide sufficient downward force to embed the beads uniformly and to the correct depth.

This insures optimum reflectivity and maximum bonding to the thermoplastic marking. They may operate by hydraulic, spring, or other biasing force, as long as the amount of force provided can be adjusted. The rollers can also be made of varying width, depending on the specific project.

Variations in ambient conditions can also be accommodated by adjusting the temperature of the beads.

This technique has many advantages over other techniques. It affords a significant increase in the useful life of thermoplastic pavement markings by embedding reflective glass beads in situ, efficiently, rapidly, and cost effectively.

By eliminating the need to heat the existing marking line material, the problems associated with scorching and discoloration are obviated. Reflectorization occurs as a single step process, which not only simplifies its administration but also leaves the line available for essentially immediate use, because of the rapid cool-down of the marking surface and sub-surface.

The technique is readily adaptable to precise application of beads of varying sizes, including even the largest beads commonly used, which are generally preferred because of their better wet- and night-visibility.

The necessary associated mechanical support equipment and procedures are consistent with existing techniques, making the invention amenable to small scale manual operation, as well as extensive automatic highway operation.

BRIEF DESCRIPTION OF THE DRAWINGS

The above and further advantages of the invention may be better understood by referring to the following description in conjunction with the accompanying drawings, in which.

DETAILED DESCRIPTION OF AN ILLUSTRATIVE EMBODIMENT

Figure 1:
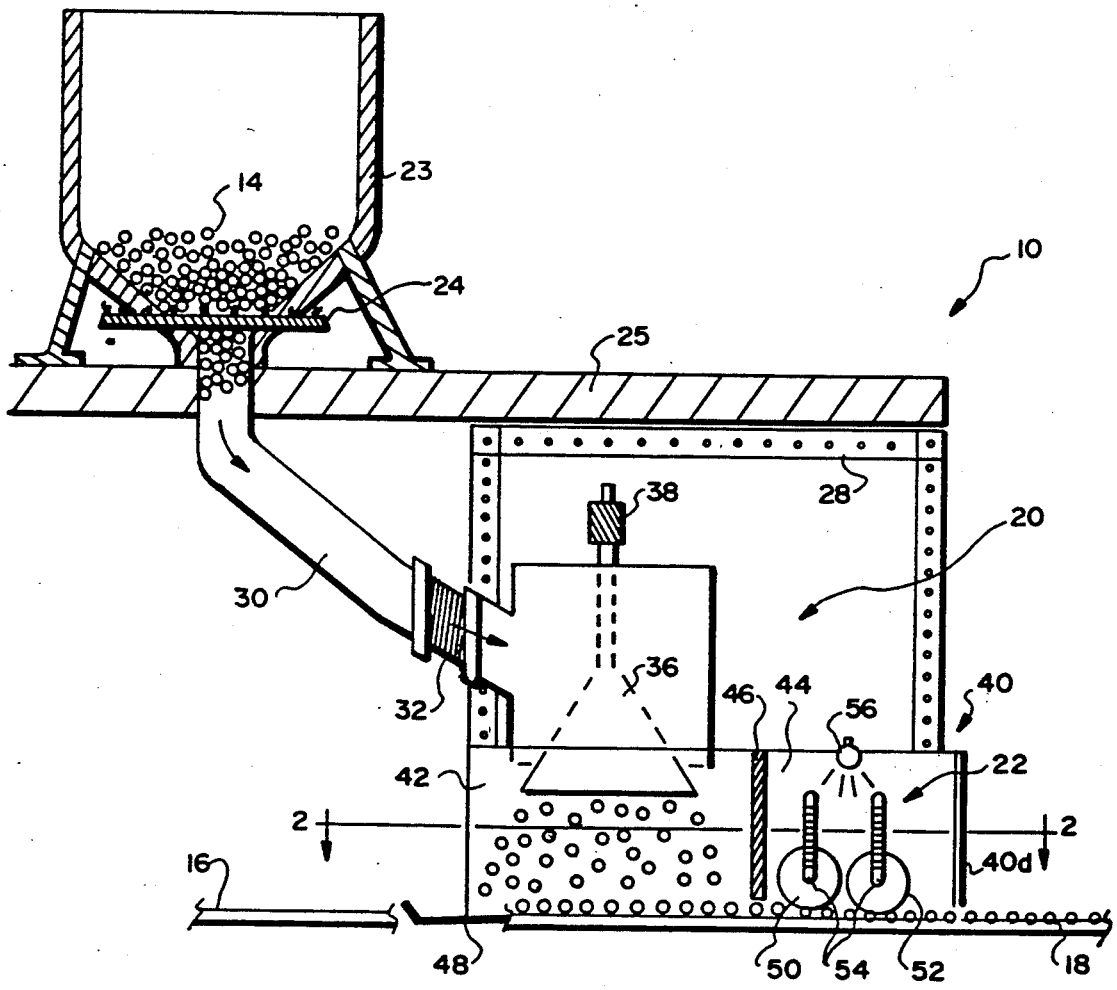
FIG. 1 is a cut-away, side elevational view of an apparatus for bead embedding constructed in accordance with the invention.

Referring now to FIG. 1, there is shown a cut-away side view of a bead embedder 10 which embeds reflective glass beads 14 into a thermoplastic highway marking line 16 which has previously been applied to the pavement, either as a paint or as a tape. In accordance with this invention, and contrary to prior reflectorization apparatus, the embedder does not directly heat the thermoplastic line 16; indeed the thermoplastic line 16 need not even be in the liquid state. Rather, the bead embedder 10 operates by directly heating only the beads 14. The beads 14 are then dropped onto the surface of the thermoplastic line 16 by a dispenser 20. Heat from each bead 14 is thus transferred to the surrounding thermoplastic material of line 16. The beads 14 are then uniformly embedded into the thermoplastic line 16 by one or more roller presses 22 before the thermoplastic material has a chance to cool.

The bead embedder 10 maintains the temperature of the beads 14 sufficiently above the melting point of the thermoplastic line so that when the beads are dropped by the dispenser 20 they immediately adhere to the line 16.

The rollers 22 may be hydraulic or spring-loaded type rollers, whichever is convenient, as long as the rollers 22 present a uniform downward face on the beads 14. If the rollers are adjustable, the beads 14 can be embedded to the depth required for optimum reflectivity and maximum bond. The rollers 22 should be positioned fairly close to the dispenser 20 to maximize heat transfer to the thermoplastic line 16 and minimize heat dissipation.

Now considering the illustrated embodiment more particularly, heating of the beads 14 is accomplished by first loading them into a tank or other container 23. The container 23 has a heater 24 fitted thereto to allow heating of the beads 14 to the desired temperature. The heater 24 is preferably adjustable, to allow better control over the depth to which beads 14 are embedded. The optimum bead temperature has been found to be in the range of 650° to 750° Fahrenheit for most applications.

A suitable support member 25 carries the container 23 and heater 24. Support member 25 may be part of a hand-propelled unit operable by a single person if the bead embedder 10 is adapted for manual use. Alternatively, support member 25 may be part of a truck, such as its rear bed. It can thus be readily appreciated that the invention is amenable to small scale manual operation, as well as extensive automatic highway operation.

The dispenser 20 is also coupled to the support 25; a frame 28 may also be necessary for adapting the dispenser 20 to the support 25. Dispenser 20 can be of conventional design, such as that presently used for original application of beads 14 to a newly applied, wet thermoplastic line 16. However, it is preferable that dispenser 20 have at least some heat-retention capability, such as that provided by using heat-resistant gaskets. The illustrated dispenser 20 is such a typical bed dispenser, using a rotating broadcaster 34 and motor 38 to uniformly disperse the beads 14. The use of such a dispenser 20 is highly recommended to avoid a bunching effect which would otherwise occur if beads 14 are simply dropped out of container 23.

The heated beads 14 are preferably channeled through an insulated feeder arm or pipe 30 from the container 23 to the dispenser 20. The insulated pipe 30 prevents heat loss as the beads 14 are passed to dispenser 20. A flexible fitting 32 can be used at the interface of the pipe 30 and the dispenser 20 to allow for variances in the angular orientation of container 23 and dispenser 20 such as those caused as bead embedder 10 vibrates while moving along the pavement.

As a result of the operation of dispenser 20, heated beads 14 are thus uniformly distributed downwards into a lower enclosure 40. Enclosure 40 is preferably divided into a forward chamber 42 and a rear chamber 44 by a deflector wall 46. Enclosure 40 is positioned so that the hot beads 14 are directed dropped into the forward chamber 42. The rear chamber 44 is primarily used to house one or more rollers 22. The deflector wall 46 serves to prevent beads 14 from entering the rear chamber 44. This is undesirable since the beads 14 might otherwise be unevenly dispersed, or worse, foul the operation of the rollers 22.

The vertical side walls of enclosure 40 such as rear enclosure wall 40*d* and deflector wall 46 are sufficiently short to have their lower edge portion positioned above the combined surface presented by the thermoplastic line 16 and adhered beads 14. These vertical side walls are also sufficiently long to prevent the beads 14 from scattering away from thermoplastic line 16 when they are dispersed by dispenser 20.

Carbide runners 48 are included on the lower periphery of the enclosure 40, positioned parallel to the thermoplastic line 16. The carbide runners 48 allow enclosure 40 to ride smoothly along the pavement surface, while also enabling the vertical side walls to be as low as possible.

Rollers 22 preferably comprise a set of adjustable steel rollers, such as the illustrated forward roller 50 and rear roller 52. Each of the rollers 50 and 52 is supported by a downward force provider such as a spring 54. The springs 54 are adjustable so that sufficient force is provided to embed beads 14 to the desired depth. Forward roller 50 is a single roller of approximately the same width as the thermoplastic line 16. Rear roller 52 is preferably a pair of narrower coaxial rollers positioned along the edges of the thermoplastic line 16. The use of a second pair of narrower rollers 52 has been found to embed the beads 14 more uniformly. For the typical four-inch wide thermoplastic line 16, the single large forward roller 50 is also about four inches wide, and each of the smaller rollers 52 about one and one-half inches wide.

For enhanced extensive operation, water spray tubing 56 may be positioned in the rear chamber 44 above the forward roller 50 and rear roller 52. Water sprayed downward over the rollers 22 towards the pavement speeds up the cooling of the hot beads 14 and re-reflectorized line 18, allowing the pavement to be used shortly after the beads 14 are applied.

Figure 2:
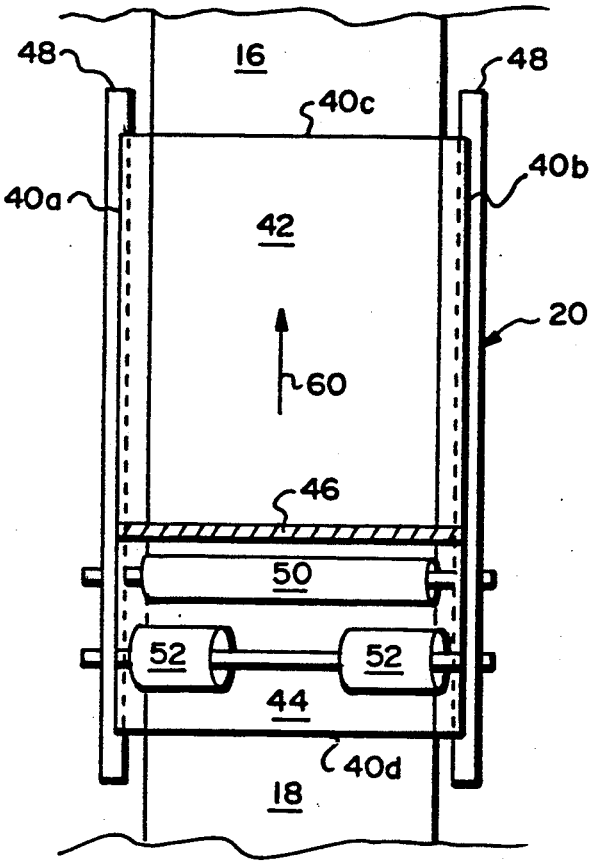
FIG. 2 is a cut-away, downward view of the apparatus for bead embedding taken along line 2—2 of FIG. 1.

FIG. 2 is a view taken along line 2—2 of FIG. 1 looking downward toward the surface of thermoplastic line 16 as it is re-reflectorized by bead embedder 10. Bead embedder 10 travels in the direction of the illustrated arrow 60, so that forward chamber 42 passes over the thermoplastic line 16 first, dispersing the beads 14 (not shown) before the rollers 50 and 52 pass over them. The runners 48 are visible on either side of the line 16. The relative positioning and size of the forward roller 50 and rear roller 52 are also evident.

Although the foregoing description of he bead embedder of the present invention has been in the context of an apparatus to re-reflectorize an existing thermosetting pavement marking line, it is evident to one of skill in the art that the same apparatus can also be used to apply reflective beads 14 to a newly applied thermoplastic line as well.

The bead embedder may easily accommodate beads of various sizes and types, depending on the specific application.

The foregoing description has been limited to a specific embodiment of this invention. It will be apparent, however, that variations and modifications may be made to the invention, with the attainment of some or all of the advantages of the invention. Therefore, it is the object of the appended claims to cover all such variations and modifications as come within the true spirit and scope of the invention.

What is claimed as new and desired to be secured by Letters Patent of the United States is:

1. A method of reapplying reflective beads to a thermoplastic pavement marking line, wherein the thermoplastic line was previously applied to the pavement, the method comprising the steps of:

A. heating the beads to a selected temperature, the selected temperature above the melting point of the thermoplastic line but below the melting point of the beads;

B. dispersing the heated beads onto the surface of the thermoplastic line; and

C. embedding the beads into the thermoplastic line by applying a downward force on the beads.

2. A method as in claim 1 wherein the step of heating the beads includes heating the beads to a temperature in the range of 650 degrees to 750 degrees Fahrenheit.

3. A method as in claim 1 additionally comprising the step of:

D. cooling the beads by spraying water over them after they are embedded into the thermoplastic line.

* * * * *